US011358749B2

(12) United States Patent
del Real Pena et al.

(10) Patent No.: US 11,358,749 B2
(45) Date of Patent: Jun. 14, 2022

(54) PACKAGING CONTAINERS AND RELATED METHODS

(71) Applicant: Fresenius Medical Care Holdings, Inc., Waltham, MA (US)

(72) Inventors: Diego Suarez del Real Pena, Mission, TX (US); Daniel Arturo Amador Cayetano, Perrysburg, OH (US); Irving Uziel Hernandez Gomez, Hidalgo, TX (US)

(73) Assignee: Fresenius Medical Care Holdings, Inc., Waltham, MA (US)

( * ) Notice: Subject to any disclaimer, the term of this patent is extended or adjusted under 35 U.S.C. 154(b) by 107 days.

(21) Appl. No.: 16/739,974

(22) Filed: Jan. 10, 2020

(65) Prior Publication Data

US 2021/0214120 A1 Jul. 15, 2021

(51) Int. Cl.

| | |
|---|---|
| ***B65D 5/54*** | (2006.01) |
| ***B65D 5/02*** | (2006.01) |
| ***B31B 50/62*** | (2017.01) |
| ***B31B 50/14*** | (2017.01) |
| ***B31B 50/00*** | (2017.01) |

(52) U.S. Cl.

CPC ..... *B65D 5/542* (2013.01); *B31B 50/0044* (2017.08); *B31B 50/14* (2017.08); *B31B 50/62* (2017.08); *B65D 5/0236* (2013.01)

(58) Field of Classification Search

CPC .... B65D 5/542; B65D 5/0236; B65D 5/4608; B65D 77/30; B65D 5/6611; B65D 5/5405; B65D 5/725; B65B 51/067; B65B 7/20

USPC ..... 229/123.2, 117.16, 123.1, 125.39, 206, 229/117.13, 240, 925; D9/416; 53/492

See application file for complete search history.

(56) References Cited

U.S. PATENT DOCUMENTS

| | | | | |
|---|---|---|---|---|
| 3,302,857 A | | 2/1967 | Martin | |
| 4,944,407 A | * | 7/1990 | Thiele | B65D 5/5415 229/123.1 |
| 5,899,372 A | | 5/1999 | Rodriguez | |

(Continued)

FOREIGN PATENT DOCUMENTS

| | | |
|---|---|---|
| GB | 2 358 855 A | 8/2001 |
| JP | 3154972 U | 10/2009 |

(Continued)

OTHER PUBLICATIONS

International Search Report and Written Opinion received for PCT Application Serial No. PCT/US2020/066709 dated Mar. 11, 2021, 7 pages.

*Primary Examiner* — Christopher R Demeree
(74) *Attorney, Agent, or Firm* — FisherBroyles, LLP

(57) ABSTRACT

The disclosed packaging containers may include a body including a sidewall and at least one top flap for at least partially covering an opening of the body when assembled and perforations in the sidewall of the body. The perforations may include a lower perforation having a first end portion and a second end portion; a first side perforation extending upward toward the top flap from the first end portion of the lower perforation; and a second side perforation extending upward from the second end portion of the lower perforation, wherein the first side perforation and the second side perforation converge toward each other as they extend upward from the lower perforation. Various other packaging containers, systems, and methods are also disclosed.

17 Claims, 10 Drawing Sheets

(56) References Cited

U.S. PATENT DOCUMENTS

| | | | | |
|---|---|---|---|---|
| 6,471,120 | B1 * | 10/2002 | Vogel | B65D 5/0227 229/117.16 |
| 9,126,718 | B2 * | 9/2015 | Lewis | B65D 5/542 |
| 10,807,760 | B1 * | 10/2020 | Telman | B65B 51/067 |
| 10,906,693 | B2 * | 2/2021 | Morimoto | B65D 5/441 |
| 2007/0063008 | A1 | 3/2007 | El-Afandi | |

FOREIGN PATENT DOCUMENTS

| | | | |
|---|---|---|---|
| JP | 3160710 | U | 7/2010 |
| JP | 2012201395 | A | 10/2012 |
| WO | 97/022529 | A1 | 6/1997 |

* cited by examiner

PACKAGING CONTAINERS AND RELATED METHODS

BACKGROUND

Shipping and storage boxes are often secured closed with adhesive tape that passes over a top of the box and along a portion of a sidewall of the box. Box cutters, knives, or scissors are frequently used to cut the adhesive tape or the box itself to open the box and access the contents inside the box. Often the contents within secured boxes are susceptible to damage if punctured or cut by these sharp objects. Some boxes that are used to contain fragile or sensitive contents are marked with a warning to avoid damage to the contents, such as "do not use sharp object to open." Such boxes are difficult to open without a sharp object, requiring a user to tear the box or the adhesive tape without a sharp tool or to peel the adhesive tape from the box by hand. Because of these difficulties, some users ignore the warnings and use a sharp object to open such boxes, risking damage to the contents of the boxes and/or risking injury to the user.

BRIEF DESCRIPTION OF THE DRAWINGS

The accompanying drawings illustrate a number of example embodiments and are a part of the specification. Together with the following description, these drawings demonstrate and explain various principles of the present disclosure.

Figure 1:
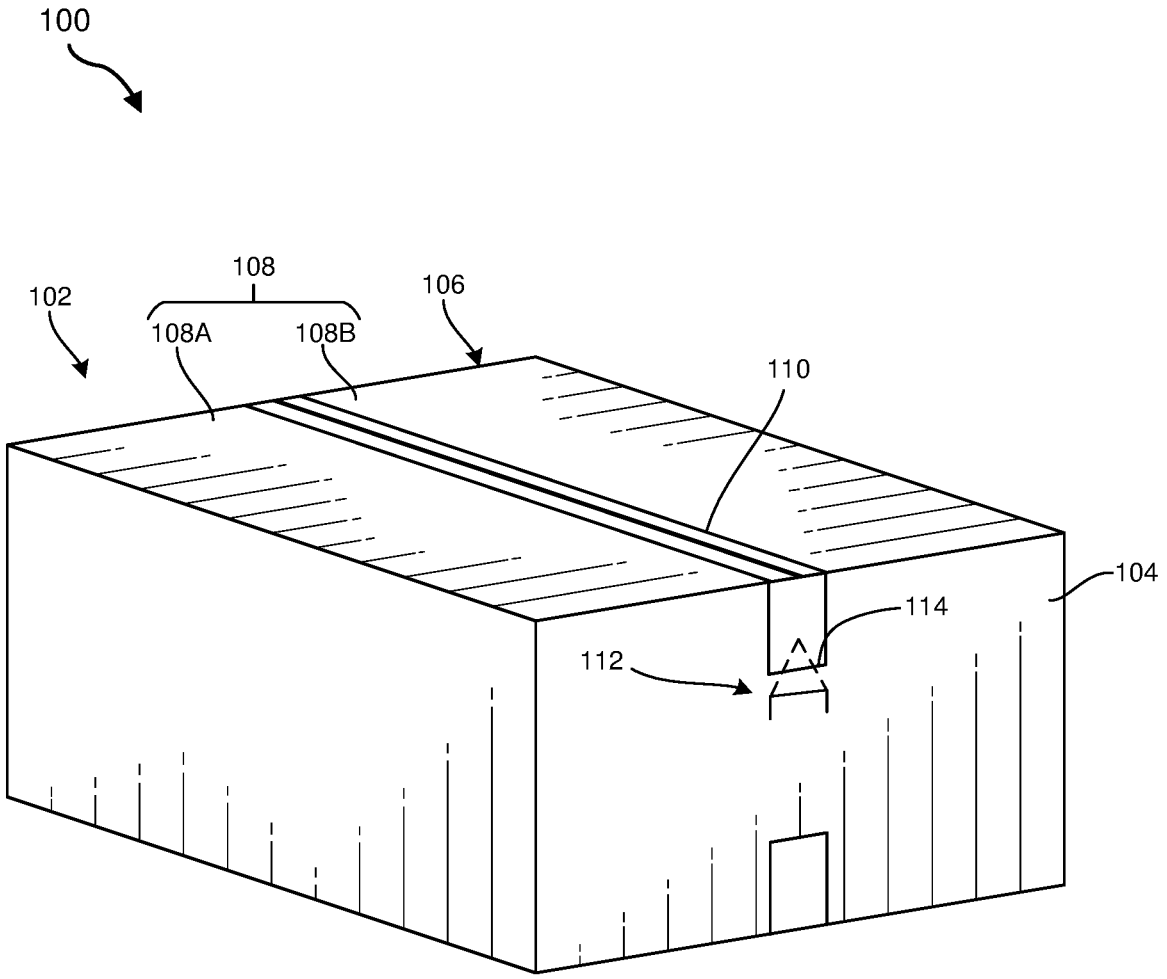
FIG. 1 is a perspective view of a packaging container, according to at least one embodiment of the present disclosure.

Throughout the drawings, identical reference characters and descriptions indicate similar, but not necessarily identical, elements. While the example embodiments described herein are susceptible to various modifications and alternative forms, specific embodiments have been shown by way of example in the drawings and will be described in detail herein. However, the example embodiments described herein are not intended to be limited to the particular forms disclosed. Rather, the present disclosure covers all modifications, equivalents, and alternatives falling within the scope of the appended claims.

DETAILED DESCRIPTION OF EXAMPLE EMBODIMENTS

The present disclosure is generally directed to packaging containers (e.g., shipping boxes, storage boxes, etc.), methods of forming packaging containers, and methods of securing packaging containers. As will be explained in further detail below, packaging containers according to some embodiments may include a body including a sidewall an at least one top flap for at least partially covering an opening of the body when assembled and perforations in the sidewall of the body. The perforations may include a lower perforation having a first end portion and a second end portion, a first side perforation extending upward from the first end portion of the lower perforation, and a second side perforation extending upward from the second end portion of the lower perforation. The first side perforation and the second side perforation may converge toward each other as they extend upward from the lower perforation. The perforations may define a removable flap that may be torn away from remaining portions of the body of the packaging containers. When the packaging container is secured in a closed position, an end of a strip of tape may be positioned over the removable flap. To open the packaging container, a user may tear away the removable flap and peel the tape away from the packaging container. Accordingly, embodiments of the present disclosure may facilitate opening packaging containers, such as by not requiring any sharp tool or object to open the packaging containers. In addition, the convergence of the first side perforation and the second side perforation toward each other may reduce a force required to tear away the removable flap, compared to flaps defined by side perforations that do not converge toward each other.

Features from any of the embodiments described herein may be used in combination with one another in accordance with the general principles described herein. These and other embodiments, features, and advantages will be more fully understood upon reading the following detailed description in conjunction with the accompanying drawings and claims.

Figure 2:
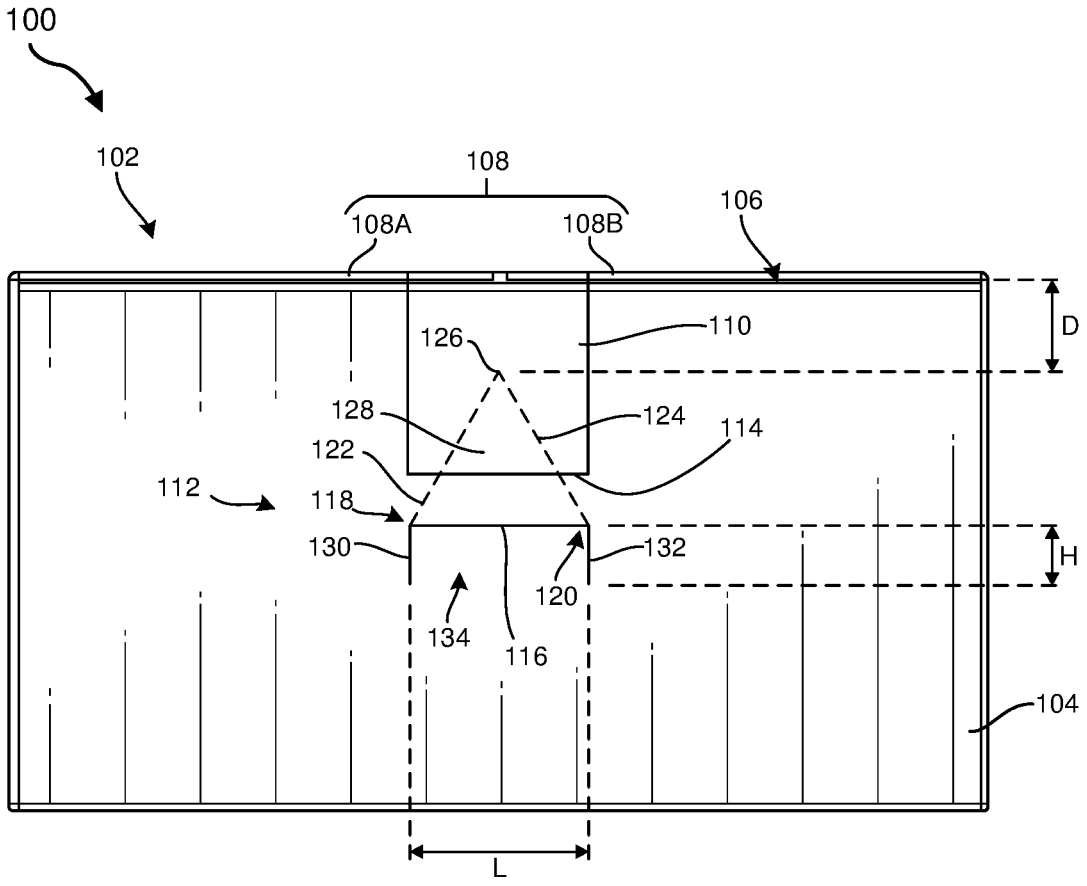
FIG. 2 is a side view of the packaging container of FIG. 1.
Figure 3:
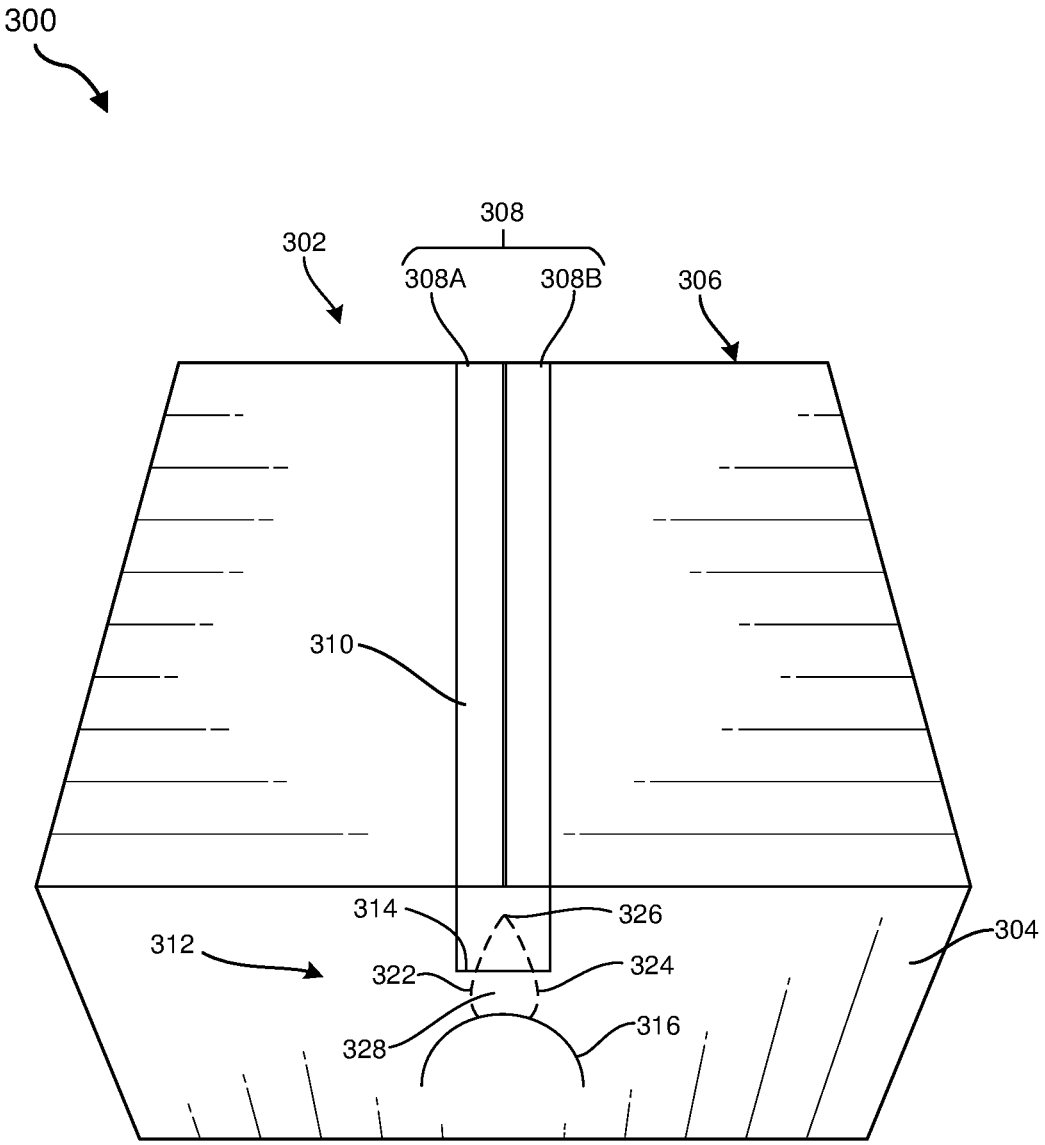
FIG. 3 is perspective view of a packaging container, according to at least one additional embodiment of the present disclosure.

The following will provide, with reference to FIGS. 1-3, detailed descriptions of packaging containers according to embodiments of the present disclosure. With reference to FIGS. 4A-4G, the following will provide detailed descriptions of how such packaging containers may be opened by a user. With reference to FIG. 5, the following will provide detailed descriptions of example methods for forming packaging containers. With reference to FIG. 6, the following will provide detailed descriptions of example methods for securing packaging containers.

FIG. 1 is a perspective view of a packaging container 100, according to at least one embodiment of the present disclosure. FIG. 2 is a side view of the packaging container 100 of FIG. 1. As illustrated in FIGS. 1 and 2, the packaging container 100 may include a body 102, which may include a sidewall 104, an opening 106 at a top of the sidewall 104, and at least one top flap 108 (e.g., a first top flap 108A and a second top flap 108B) configured to substantially cover the opening 106 when the packaging container 100 is closed. Tape 110 may be adhered to the packaging container 100 over the top flap(s) 108 and partially along the sidewall 104 to secure the packaging container 100 in a closed state. The sidewall 104 may include a group of perforations 112 to facilitate removal of the tape 110 and opening the packaging container 100, as will be explained further below. An end 114 of the tape 110 may be positioned over the group of perforations 112.

In some examples, the term "substantially" in reference to a given parameter, property, or condition may mean and include to a degree that one of ordinary skill in the art would understand that the given parameter, property, or condition is met with a small degree of variance, such as within acceptable manufacturing tolerances. By way of example, depending on the particular parameter, property, or condition that is substantially met, the parameter, property, or condition may be at least 90% met, at least 95% met, or even at least 99% met. In some examples, relational terms, such as "first," "second," "lower," "downward," "upward," "top," "over," "under," etc., may be used for clarity and convenience in understanding the disclosure and accompanying drawings and may not necessarily connote or depend on any specific preference, orientation, or order, except where the context clearly indicates otherwise.

The body 102 may be formed of any material that is suitable for packaging containers, such as shipping containers or storage containers. By way of example and not limitation, the body 102 may be formed of a cardboard material (e.g., corrugated or non-corrugated cardboard), a paper material, a plastic material, etc. Additionally, the packaging container 100 may be provided in an assembled state (e.g., as shown in FIGS. 1 and 2), in a partially assembled state (e.g., with the top flap(s) 108 in an open position), or in an unassembled state (e.g., as a generally flat piece of material to be folded, glued, taped, and/or otherwise assembled).

The top flap(s) 108 of the body 102 may have a variety of configurations. By way of example and not limitation, the first top flap 108A and the second top flap 108B may be sized and configured to fold toward a center of the opening 106. The first top flap 108A and the second top flap 108B may be configured to overlap each other when closed, or may be configured to close (e.g., fully or partially close) over the opening 106 in a non-overlapping manner. The top flap(s) 108 may also include a third flap and a fourth flap that are configured to be positioned under the first top flap 108A and the second top flap 108B when closed.

The tape 110 may be any type of adhesive tape suitable for securing the packaging container 100 in a closed position, such as packing tape, fiber-reinforced packing tape, paper tape, polymer tape, metallic tape, cloth tape, etc.

Referring to FIG. 2, the group of perforations 112 may include a lower perforation 116 that includes a first end portion 118 and a second, opposite end portion 120. A first side perforation 122 may extend upward (e.g., toward the opening 106 and the top flap(s) 108) from the first end portion 118 of the lower perforation 116. A second side perforation 124 may extend upward from the second end portion 120 of the lower perforation 116. The first side perforation 122 and the second side perforation 124 may converge toward each other as they extend upward from the lower perforation 116. In some examples, the first side perforation 122 and the second side perforation 124 may reach each other at an apex 126. The lower perforation 116, first side perforation 122, and second side perforation 124 may define a removable flap 128 therebetween. The removable flap 128 may be removable upon tearing the sidewall 104 along the lower perforation 116, first side perforation 122, and second side perforation 124. In some embodiments, the removable flap 128 may have a triangular shape, as illustrated in FIGS. 1 and 2.

Referring again to FIG. 2, the group of perforations 112 may also include a first bottom perforation 130 extending downward (e.g., away from the opening 106 and top flap(s) 108) from the first end portion 118 of the lower perforation 116 and a second bottom perforation 132 extending downward from the second end portion 120 of the lower perforation 116. A lower flap 134 may be defined between the lower perforation 116, first bottom perforation 130, and second bottom perforation 132.

Each of the lower perforation 116, first side perforation 122, second side perforation 124, first bottom perforation 130, and second bottom perforation 132 may include one or more slits and/or holes in the sidewall 104 of the body 102. For example, as illustrated in FIG. 2, the lower perforation 116, first bottom perforation 130, and second bottom perforation 132 may each include a single slit, and the first side perforation 122 and second side perforation 124 may each include a series of slits or holes. In some examples, one or more of the lower perforation 116, first side perforation 122, second side perforation 124, first bottom perforation 130, and/or second bottom perforation 132 may include at least one relatively long slit and a series of shorter slits or holes. In some embodiments, each of the lower perforation 116, first side perforation 122, second side perforation 124, first bottom perforation 130, and second bottom perforation 132 may have a linear shape, as shown in FIG. 2.

The group of perforations 112 may be positioned in a laterally central position in the sidewall 104 to be substantially aligned with the tape 110 used to close the packaging container 100. By way of example and not limitation, the lower perforation 116 may be positioned at or above a midpoint of the sidewall 104. The lower perforation 116 may have a length L that is suitable for a user to press in the lower flap 134 with one or more fingers to reach behind the removable flap 128. For example, the length L of the lower perforation 116 may be at least about 1.5 inches, such as between about 1.5 inches and about 6.0 inches. Each of the first bottom perforation 130 and the second bottom perforation 132 may have a height H that is also suitable for the user to press in the lower flap 134 with one or more fingers. For example, the height H of the first bottom perforation 130 and of the second bottom perforation 132 may be at least about 1.0 inch, such as between about 1.0 inch and about 3.0 inches.

The removable flap 128 may be located on the sidewall 104 below the opening 106. In some examples, the apex 126 of the removable flap 128 where the first side perforation 122 and the second side perforation 124 meet may be positioned a distance D below the opening 106. By way of example and not limitation, the distance D between the apex 126 and the opening 106 may be at least about 1.0 inch, such as between about 1.0 inch and about 8.0 inches. In additional embodiments, the first side perforation 122 and the second side perforation 124 may extend upward from the lower perforation 112 to reach the opening 106.

The convergence of the first side perforation 122 toward the second side perforation 124 may facilitate removal of the removable flap 128 by tearing the sidewall 104 along the first side perforation 122 and the second side perforation 124 starting at the lower perforation 116. For example, as the removable flap 128 is torn from the sidewall 104 starting at the lower perforation 116, the tears along the first side perforation 122 and second side perforation 124 may become closer to each other. When the tears reach the apex 126, the force required to finish removing the removable flap 128 may significantly drop, since the final distance between the respective tears may be relatively small or zero.

FIG. 3 is perspective view of a packaging container 300, according to at least one additional embodiment of the present disclosure. In some respects, the packaging container 300 of FIG. 3 may be similar to the packaging container 100 described above in connection with FIGS. 1 and 2. For example, the packaging container 300 may include a body 302, a sidewall 304, an opening 306, at least one top flap 308 for covering the opening 306, and a group of perforations 312 in the sidewall 304. The group of perforations 312 may define a removable flap 328. The packaging container 300 may be configured for closing with tape 310 positioned over a portion of the top flap(s) 308, such as along a seam between a first top flap 308A and a second top flap 308B. An end 314 of the tape 310 may be positioned over the removable flap 328.

As illustrated in FIG. 3, the group of perforations 312 may include a lower perforation 316, a first side perforation 322 extending upward (e.g., toward the opening 306 and the top flap(s) 308) from a first end portion 318 of the lower perforation 316, and a second side perforation 324 extending upward from a second end portion 320 of the lower perforation 316. However, in contrast to the group of perforations 112 discussed above with reference to FIGS. 1 and 2, at least one of the lower perforation 316, first side perforation 322, and/or second side perforation 324 may be curved rather than straight. For example, the lower perforation 316 may be substantially semicircular, like an upside-down U shape. The first side perforation 322 and the second side perforation 324 may extend upward and laterally outward from the lower perforation 316 and may curve laterally inward to converge toward each other. For example, the first side perforation 322 and the second side perforation 324 may converge to reach each other at an apex 326. The removable flap 328 may be defined between the lower perforation 316, the first side perforation 322, and the second side perforation 324.

In additional embodiments, the lower perforation 316, first side perforation 322, and second side perforation 324 may have different shapes or combinations of shapes. For example, the lower perforation 316 may be substantially linear, like the lower perforation 116 of FIGS. 1 and 2, with the first side perforation 322 and the second side perforation 324 being curved as shown in FIG. 3. Alternatively, the lower perforation 316 may be curved as shown in FIG. 3, with the first side perforation 322 and the second side perforation 324 being substantially linear, like the first side perforation 122 and the second side perforation 124 shown in FIGS. 1 and 2. Thus, a variety of configurations and shapes may be used for the group of perforations 312.

Figure 4:
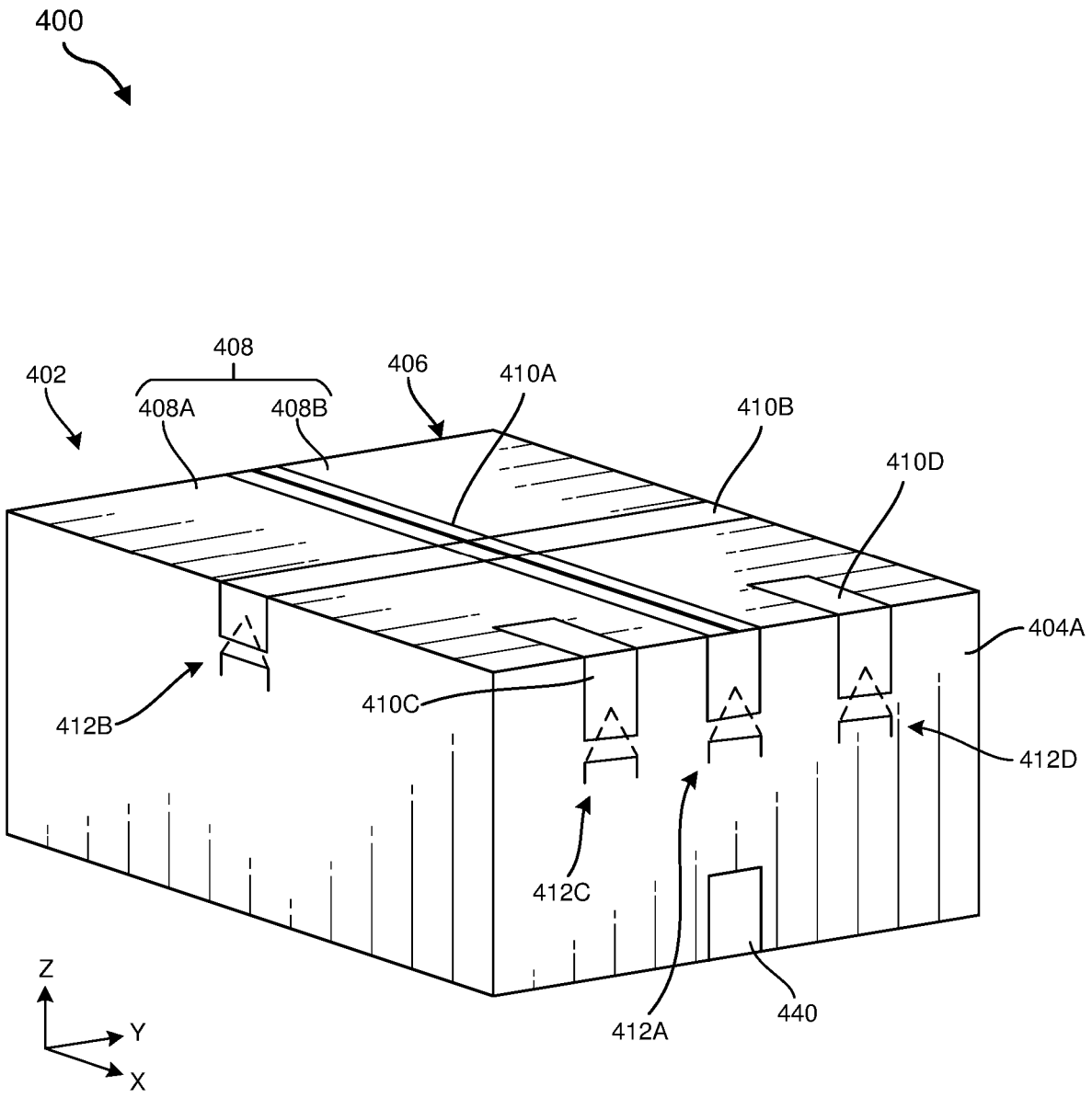
FIG. 4 is a perspective view of a packaging container, according to at least one further embodiment of the present disclosure.

FIG. 4 is a perspective view of a packaging container 400, according to at least one further embodiment of the present disclosure. In some respects, the packaging container 400 of FIG. 4 may be similar to the packaging container 100 described above in connection with FIGS. 1 and 2. For example, the packaging container 400 may include a body 402, an opening 406, and at least one top flap 408 (e.g., a first top flap 408A and a second top flap 408B) for covering the opening 406.

As illustrated in FIG. 4, the packaging container 400 may be securable by multiple strips of tape 410 (individually identified as first strip of tape 410A, second strip of tape 410B, third strip of tape 410C, and fourth strip of tape 410D). When the packaging container 400 is secured in a closed position, the first strip of tape 410A may be positioned along a seam between the first top flap 408A and the second top flap 408B, such as centrally across the opening 406 and over the top flap(s) 408 in a first direction X. The second strip of tape 410B may be positioned centrally across the opening 406 in a second direction Y that is transverse to (e.g., perpendicular to) the first direction of the first strip of tape 410A. The third strip of tape 410C may be positioned over an upper edge of a first sidewall 404A of the body 402, such as in the first direction X and parallel to the first strip of tape 410A. The third strip of tape 410C may secure the first top flap 408A in a closed position. The fourth strip of tape 410D may also be positioned over the upper edge of the first sidewall 404A, such as in the first direction X and parallel to the first strip of tape 410A. The fourth strip of tape 410D may secure the second top flap 408B in a closed position. The third strip of tape 410C and the fourth strip of tape 410D may be positioned on opposing sides of the first strip of tape 410A, as illustrated in FIG. 4.

The packaging container 400 may include multiple groups of perforations 412 (individually identified as group of first perforations 412A, group of second perforations 412B, group of third perforations 412C, and group of fourth perforations 412D) corresponding to respective ends of the strips of tape 410. The group of first perforations 412A may be located in the first sidewall 404A in a laterally central position to be under an end of the first strip of tape 410A. The group of second perforations 412B may be located in a second sidewall 404B adjacent to the first sidewall 404A in a position to be under an end of the second strip of tape 410B. The group of third perforations 412C may be located in the first sidewall 404A in a position to be under an end of the third strip of tape 410C. The group of fourth perforations 412D may be located in the first sidewall 404A in a position to be under an end of the fourth strip of tape 410D. Each of the groups of perforations 412 may have a configuration as described above with reference to any of FIGS. 1-3.

Accordingly, the packaging container 400 may have any number of groups of perforations 412 to facilitate removal of any corresponding number of strips of tape 410. The groups of perforations 412 may be positioned in a variety of locations where the strips of tape 410 are expected to be positioned when the packaging container 400 is secured in a closed state. In addition, one or more groups of perforations 412 may be positioned under an end of a lower strip of tape 440 to facilitate removal of the lower strip of tape 440 in a similar fashion to the strips of tape 410 positioned over the top flap(s) 408.

Figure 5A:
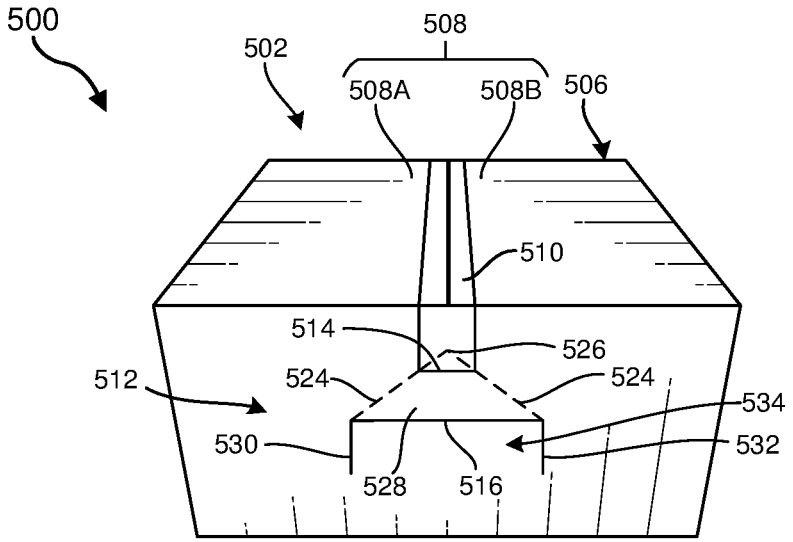
FIGS. 5A-5G illustrate various stages of a user opening a packaging container, according to at least one embodiment of the present disclosure.

FIGS. 5A-5G illustrate various stages of a user opening a packaging container 500, according to at least one embodiment of the present disclosure. The packaging container 500 may be similar to or the same as any of the packaging containers 100, 300, 400 described above. FIG. 5A illustrates the packaging container 500 in a closed state, with tape 510 positioned over a seam between a first top flap 508A and a second top flap 508B that are folded over an opening 506 of the packaging container 500. An end 514 of the tape 510 may be positioned over a removable flap 528 defined by a group of perforations 512. For example, the removable flap 528 may be defined by a lower perforation 516, a first side perforation 522, and a second side perforation 524 of the group of perforations 512. The first side perforation 522 and the second side perforation 524 may converge toward each other as they extend upward from the lower perforation 516. A lower flap 534 may be defined between the lower perforation 516, a first bottom perforation 530, and a second bottom perforation 532 of the group of perforations 512. In the illustrated embodiment, the lower perforation 516, first bottom perforation 530, and second bottom perforation 532 may each be defined by a single slit in the body 502 of the packaging container 500. The first side perforation 522 and the second side perforation 524 may be defined by a series of slits or holes. The first side perforation 522 and the second side perforation 524 may converge to reach each other at an apex 526.

Figure 5B:
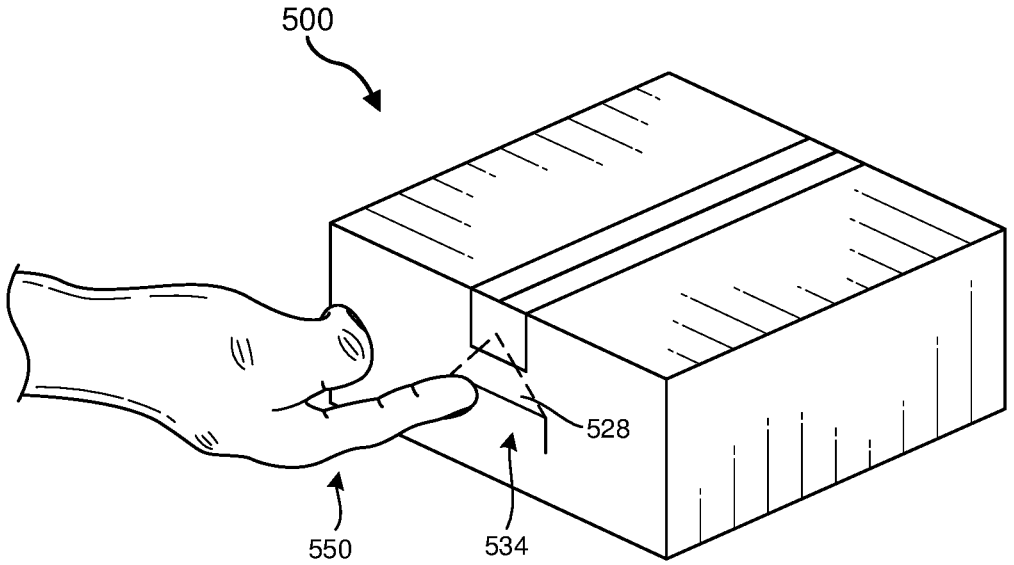
Figure 5C:
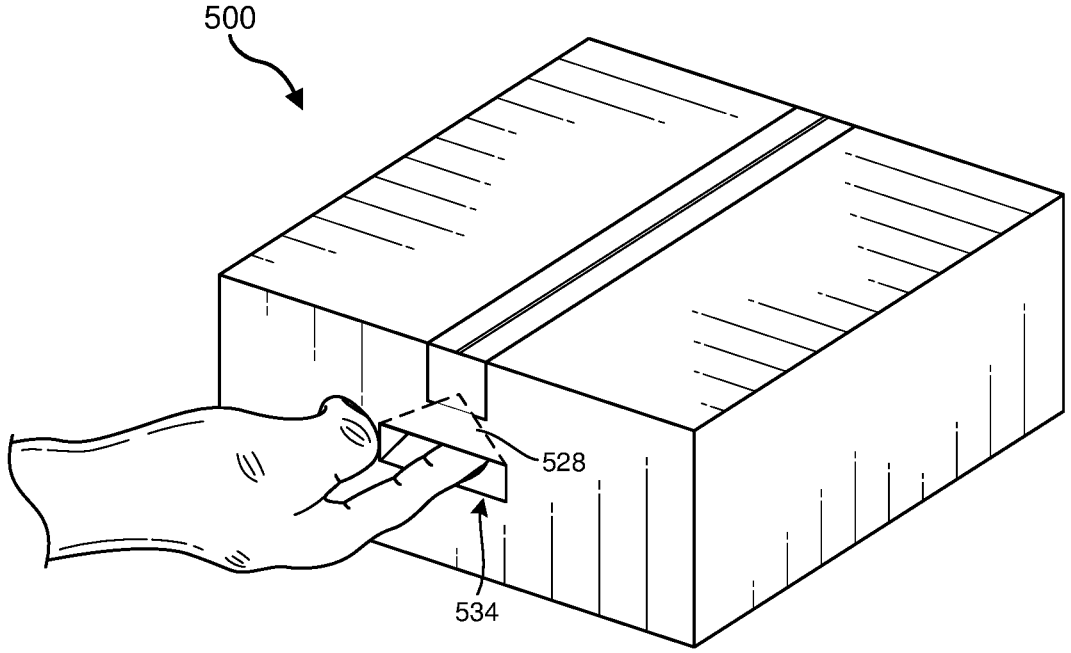
Figure 5D:
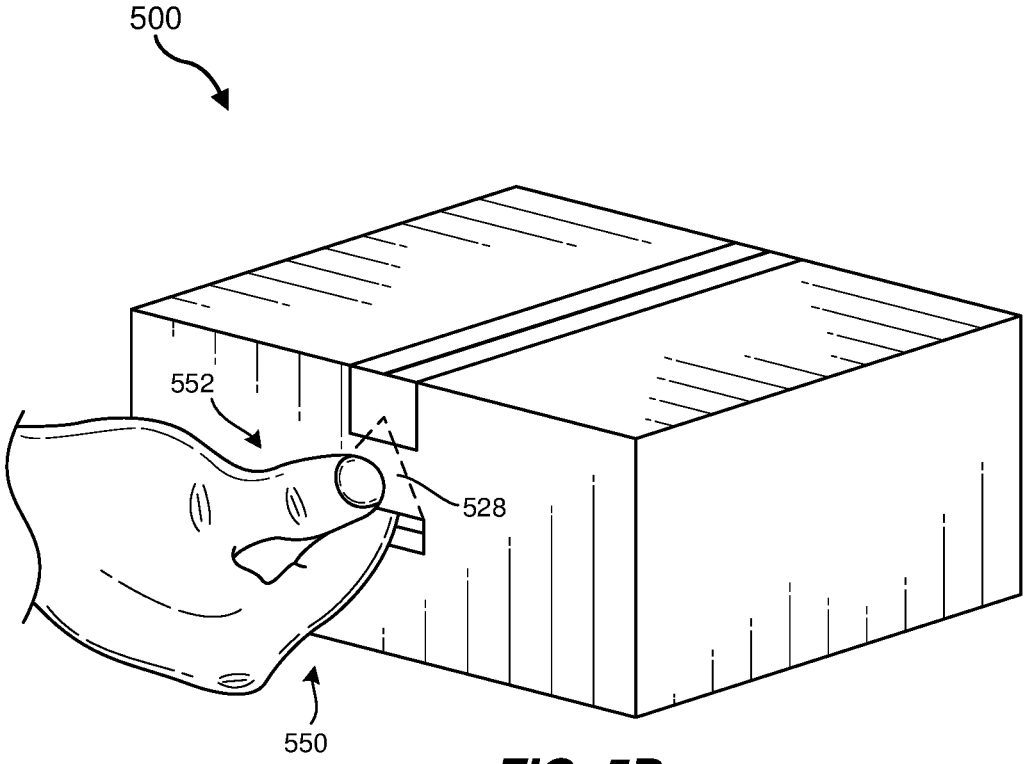
Figure 5E:
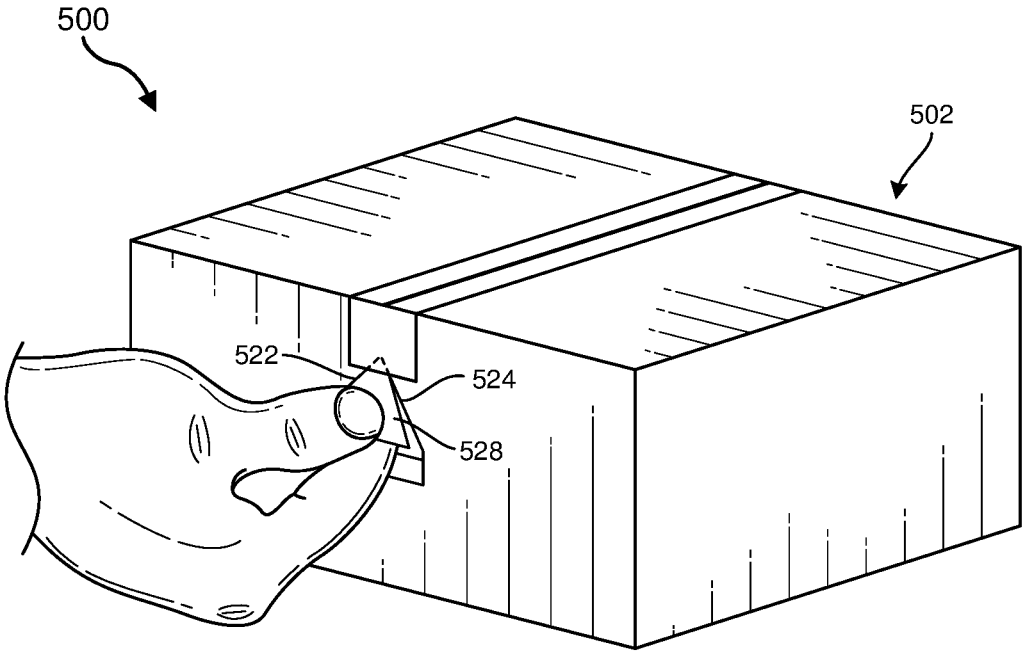
Figure 6:
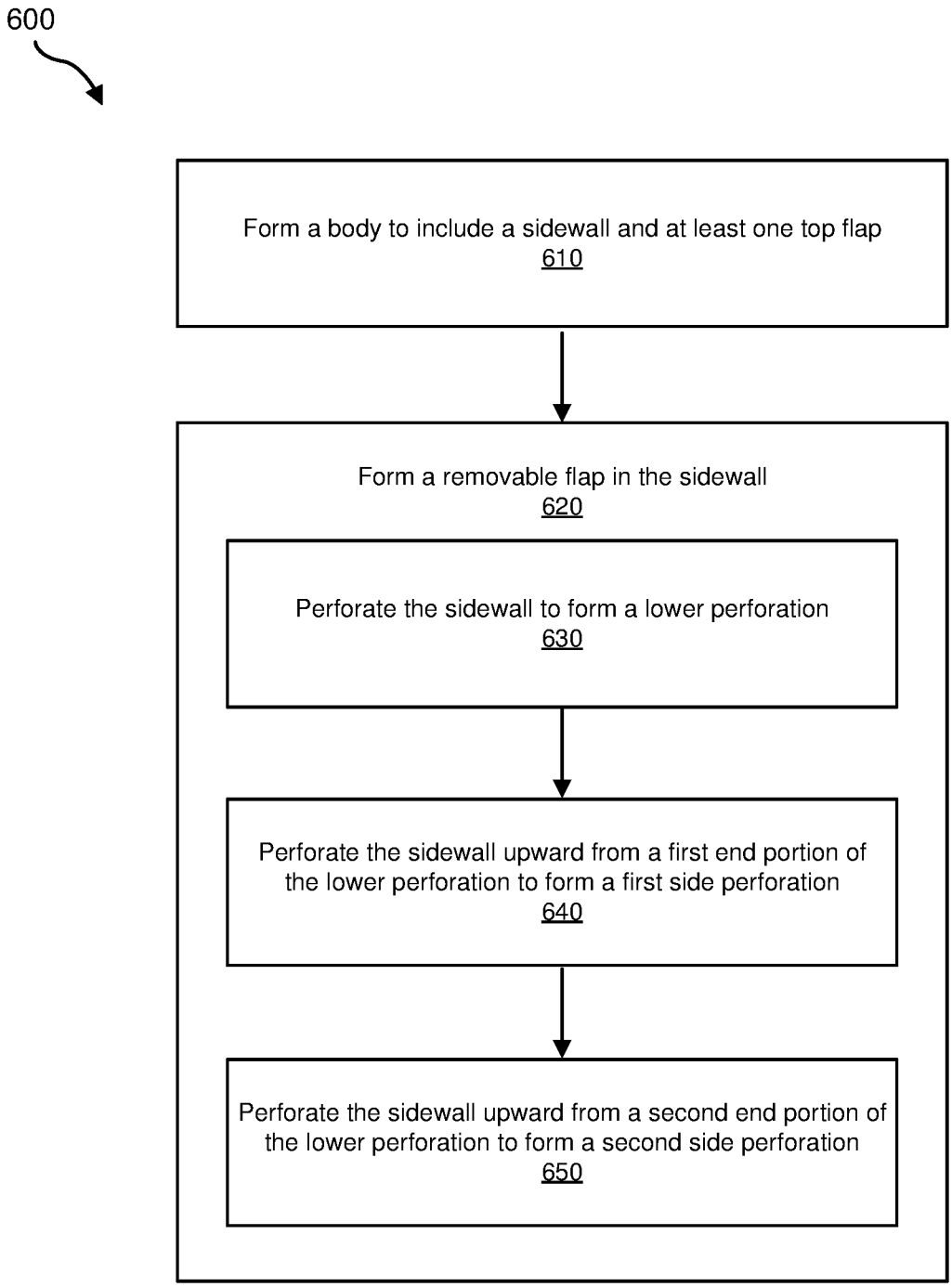
FIG. 6 is a flow diagram illustrating an example method for forming a packaging container, according to at least one embodiment of the present disclosure.

Referring to FIG. 5B, a user desiring to open the secured packaging container 500 may press a finger 550 or multiple fingers 550 against the lower flap 534. As shown in FIG. 5C, the lower flap 534 may fold inward into an interior of the packaging container 500, such that the user's finger(s) 550 may reach behind the removable flap 528. As illustrated in FIG. 5D, the user may grasp a lower portion of the removable flap 528, such as between the finger(s) 550 and thumb 552. As illustrated in FIG. 5E, the user may begin to tear the body 502 of the packaging container 500 upward along one or both of the first side perforation 522 and/or the second side perforation 524 by pulling the removable flap 528 outward and upward.

Figure 5F:
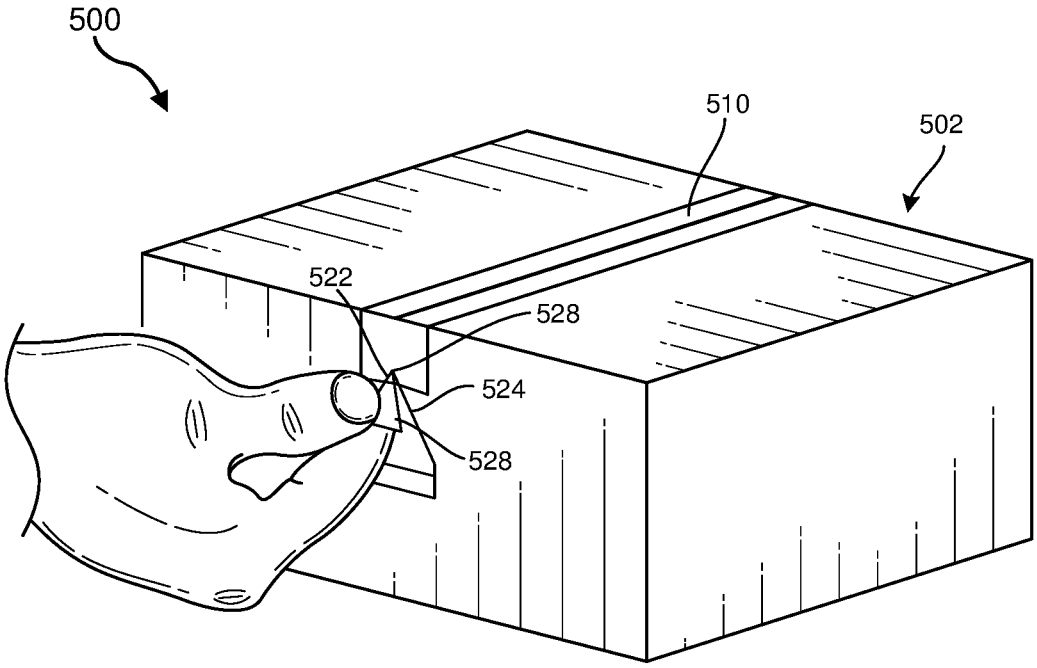
Figure 5G:
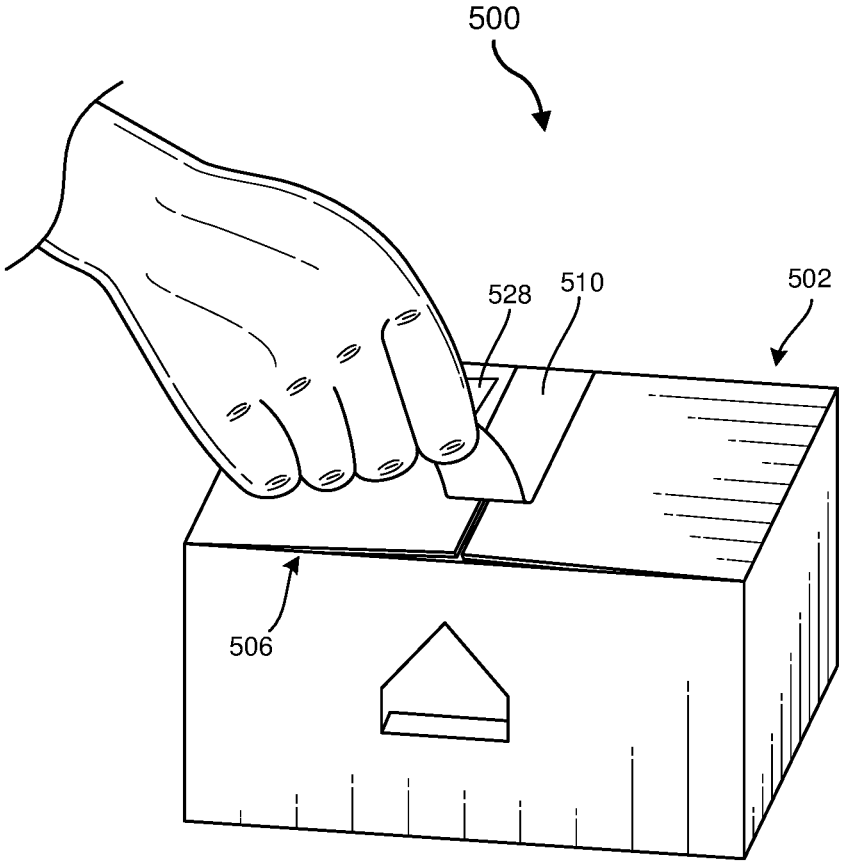

Referring to FIG. 5F, the user may continue to tear the body 502 of the packaging container 500 upward and outward and the tape 510 may begin to be lifted away from the body 502, being pulled away from the body 502 by the removable flap 528 to which an end the tape 510 is adhered. As the tears through the first side perforation 522 and the second side perforation 524 approach the apex 526 where the first side perforation 522 and the second side perforation 524 reach each other, the force required to tear off the removable flap 528 from the remaining portions of the body 502 may reduce. Referring to FIG. 5G, the removable flap 528 may be fully removed from the remainder of the body 502, and the user may continue to peel the tape 510 from the packaging container 500 by grasping and pulling the removable flap 528 up and over the opening 506 of the packaging container 500. The tape 510 may then be fully removed and the packaging container 500 may be opened without the use of a sharp tool.

FIG. 6 is a flow diagram illustrating a method 600 for forming a packaging container. At operation 610, a body of the packaging container may be formed to include a sidewall and at least one top flap. Operation 610 may be performed in a variety of ways. For example, the body may be formed (e.g., stamped, cut, etc.) from a cardboard material, a paper material, a plastic material, etc. The at least one top flap may be configured to fold at least partially over an opening in the body of the packaging container.

At operation 620, a removable flap may be formed in the sidewall. Operation 620 may be performed in a variety of ways. For example, the removable flap may be formed to be located in a laterally central position in the sidewall, or in another position in the sidewall. As discussed above with reference to FIG. 2, the removable flap may be positioned below an opening in the body of the packaging container.

As illustrated in FIG. 6, operation 620 of forming a removable flap may include perforating the sidewall to form a lower perforation, as identified at operation 630. The sidewall may be perforated upward from a first end portion of the lower perforation to form a first side perforation, as identified at operation 640. The sidewall may also be perforated upward from a second end portion of the lower perforation to form a second side perforation, as identified at operation 650. The first side perforation and the second side perforation may be formed to converge toward each other as they extend upward from the lower perforation. The perforations of the operations 630, 640, and 650 may be performed in a variety of ways. For example, each of the perforations may be cut, stamped, pierced, or otherwise formed in the sidewall to include a single slit, a series of slits or holes, at least one relatively long slit with a series of smaller slits or holes, etc. In addition, the perforations may be formed in a linear fashion, in a curved fashion, or to include a combination of linear and curved segments.

In some examples, the method 600 may further include forming a lower flap. For example, as explained above with reference to FIG. 2, the lower flap may be formed by perforating the sidewall downward from the first end portion of the lower perforation to form a first bottom perforation and by perforating the sidewall downward from the second end portion of the lower perforation to form a second bottom perforation. The first bottom perforation, lower perforation, and second bottom perforation may define three sides of the lower flap.

Figure 7:
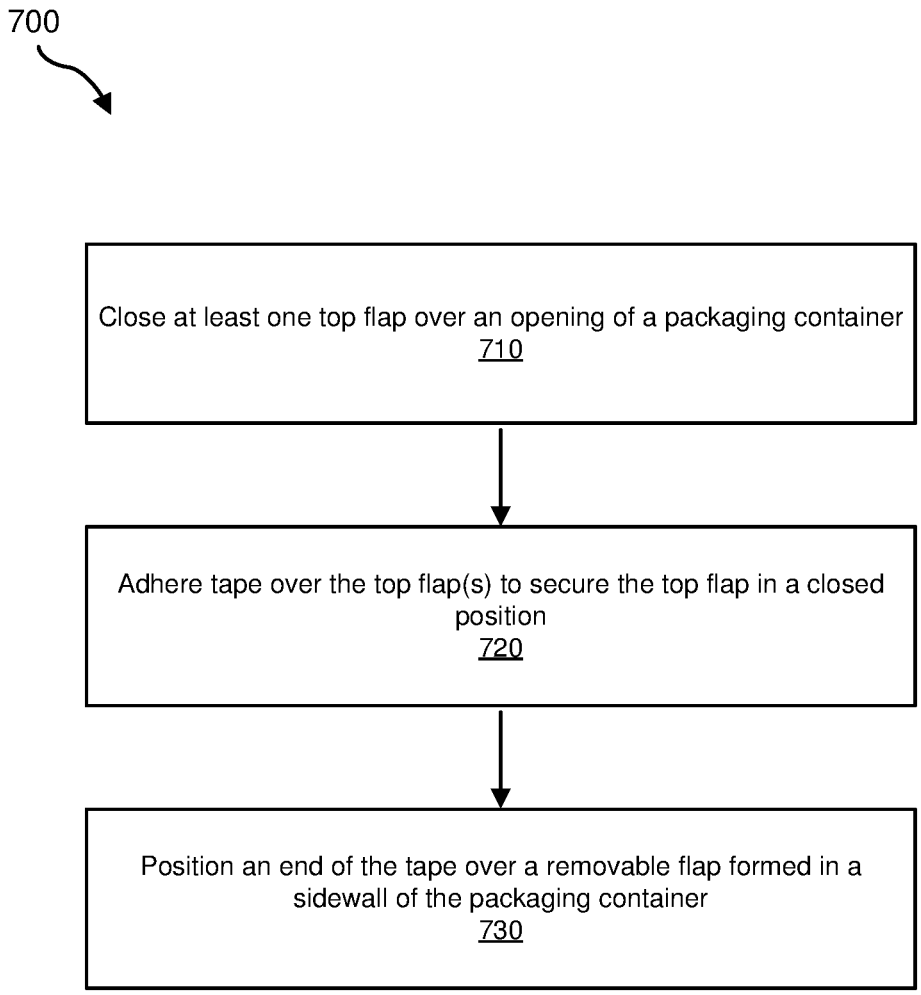
FIG. 7 is a flow diagram illustrating an example method for securing a packaging container, according to at least one embodiment of the present disclosure.

FIG. 7 is a flow diagram illustrating an example method 700 for securing a packaging container, according to at least one embodiment of the present disclosure. At operation 710, at least one top flap may be closed over an opening of a packaging container. Operation 710 may be performed in a variety of ways. For example, a first top flap and a second top flap may be folded over the opening and toward each other into a closed position. In the closed position, the first top flap and the second top flap may overlap each other or may not overlap each other. In some embodiments, a third top flap and a second top flap may also be folded at least partially over the opening and toward each other in a closed position.

At operation 720, tape may be adhered over the top flap(s) (e.g., over a seam between the first top flap and the second top flap) to secure the top flap(s) in a closed position. Operation 720 may be performed in a variety of ways. For example, the tape may be applied to the top flap(s) from a handheld tape dispenser, an automated tape dispenser, from a roll of tape without a dispenser, etc.

At operation 730, an end of the tape may be positioned over a removable flap formed in a sidewall of the packaging container. Operation 730 may be performed in a variety of ways. For example, an entire end portion of the tape (e.g., an entire width of the tape) may be positioned over the removable flap. In additional embodiments, only a segment of the end portion of the tape (e.g., only a portion of the width of the tape) may be positioned over the removable flap.

The removable flap over which the end of the tape is positioned at operation 730 may be defined by a lower perforation having a first end portion and a second end portion, a first side perforation extending upward (e.g., toward the opening of the packaging container) from the first end portion of the lower perforation, and a second side perforation extending upward from the second end portion of the lower perforation. The first side perforation and the second side perforation may converge toward each other as they extend upward from the lower perforation. By way of example and not limitation, the removable flap may have a triangular shape.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. For example, the positioning of the end of the tape over the removable flap in operation 730 may be performed prior to the adhering of the tape over the top flap(s) of operation 710. The various example methods described and/or illustrated herein may also omit one or more of the steps described or illustrated herein or include additional steps in addition to those disclosed.

Accordingly, the present disclosure includes packaging containers and associated methods that may provide one or more improvements over conventional packaging containers. For example, the packaging containers of the present disclosure may be suitable for containing materials or items that may be sensitive to being punctured or cut by sharp tools, such as box cutters, scissors, and the like. The packaging containers of the present disclosure may include a removable flap defined by a lower perforation, a first side perforation extending upward from the lower perforation, and a second side perforation extending upward from the lower perforation. The first and second side perforations may converge toward each other as they extend upward from the lower perforation. This convergence of the first and second side perforations toward each other (e.g., to reach an apex) may facilitate removal of the removable flap from a remaining portion of a body of the packaging containers.

The following example embodiments are also included in the present disclosure.

Example 1: A packaging container, which may include: a body including a sidewall and at least one top flap for at least partially covering an opening of the body when assembled; and perforations in the sidewall of the body, the perforations including: a lower perforation having a first end portion and a second end portion; a first side perforation extending upward toward the top flap from the first end portion of the lower perforation; and a second side perforation extending upward toward the top flap from the second end portion of the lower perforation, wherein the first side perforation and the second side perforation converge toward each other as they extend upward from the lower perforation.

Example 2: The packaging container of Example 1, wherein the perforations are, as a group, positioned in a laterally central position in the sidewall.

Example 3: The packaging container of Example 1 or Example 2, wherein the lower perforation includes a single slit extending from the first end portion to the second end portion.

Example 4: The packaging container of any of Examples 1 through 3, wherein the perforations further include: a first bottom perforation extending downward from the first end portion of the lower perforation away from the top flap; and a second bottom perforation extending downward from the second end portion of the lower perforation away from the top flap, wherein the lower perforation, the first bottom perforation, and the second bottom perforation define three sides of a lower flap.

Example 5: The packaging container of any of Examples 1 through 4, wherein the lower perforation has a length of at least about 1.5 inches.

Example 6: The packaging container of any of Examples 1 through 5, wherein the first side perforation and the second side perforation converge to reach each other at an apex.

Example 7: The packaging container of any of Examples 1 through 6, wherein each of the first side perforation and the second side perforation is linear.

Example 8: The packaging container of any of Examples 1 through 7, wherein the lower perforation, first side perforation, and second side perforation define a removable flap therebetween.

Example 9: The packaging container of Example 8, wherein the removable flap has a triangular shape with an apex converging at an upper portion of the removable flap closest to the at least one top flap.

Example 10: The packaging container of Example 8 or Example 9, wherein the removable flap is located on the sidewall below the opening.

Example 11: The packaging container of Example 10, wherein a distance between the opening and the removable flap is at least about 1.0 inch.

Example 12: The packaging container of any of Examples 1 through 11, wherein the at least one top flap includes two top flaps configured to fold toward a center of the opening.

Example 13: The packaging container of any of Examples 1 through 12, wherein the body includes a cardboard body.

Example 14: A method of forming a packaging container, which may include: forming a body to include a sidewall and at least one top flap; and forming a removable flap in the sidewall, including: perforating the sidewall to form a lower perforation having a first end portion and a second end portion; perforating the sidewall upward from the first end portion of the lower perforation to form a first side perforation; and perforating the sidewall upward from the second end portion of the lower perforation to forma second side perforation, wherein the first side perforation and the second side perforation converge toward each other as they extend upward from the lower perforation.

Example 15: The packaging container of any of Example 14, wherein perforating includes at least one of: forming a single slit and/or forming a series of slits or holes.

Example 16: The packaging container of Example 14 or Example 15, which may further include forming a lower flap, including: perforating the sidewall downward from the first end portion of the lower perforation to form a first bottom perforation; and perforating the sidewall downward from the second end portion of the lower perforation to form a second bottom perforation, wherein the first bottom perforation, lower perforation, and second bottom perforation define three sides of the lower flap.

Example 17: The packaging container of any of Examples 14 through 16, wherein: perforating the sidewall to form the lower perforation includes forming a single slit between the first end portion and the second end portion; perforating the sidewall to form the first side perforation includes forming a first series of multiple slits or holes; and perforating the sidewall to form the second side perforation includes forming a second series of multiple slits or holes.

Example 18: The method of any of Examples 14 through 17, wherein perforating the sidewall to form the lower perforation includes perforating the sidewall in a curved shape.

Example 19: A method of securing a packaging container, which may include: closing at least one top flap over an opening of the packaging container; adhering tape over the top flap to secure the top flap in a closed position; and positioning an end of the tape over a removable flap formed in a sidewall of the packaging container, wherein the removable flap is defined by: a lower perforation having a first end portion and a second end portion; a first side perforation extending upward from the first end portion of the lower perforation; and a second side perforation extending upward from the second end portion of the lower perforation, wherein the first side perforation and the second side perforation converge toward each other as they extend upward from the lower perforation.

Example 20: The method of Example 19, wherein positioning the end of the tape over the removable flap includes positioning the end of the tape over a triangular removable flap.

The preceding description has been provided to enable others skilled in the art to best utilize various aspects of the example embodiments disclosed herein. This example description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A packaging container, comprising:

a body including a sidewall and at least one top flap for at least partially covering an opening of the body when assembled; and perforations in the sidewall of the body, the perforations including:

a lower slit parallel to the top flap and having a first end portion and a second end portion;

a first side perforation extending upward toward the top flap from the first end portion of the lower slit;

a second side perforation extending upward toward the top flap from the second end portion of the lower slit, wherein the first side perforation and the second side perforation converge toward each other as they extend upward from the lower slit, wherein the first side perforation and the second side perforation converge to reach each other at a pointed apex;

a first bottom slit extending downward from the first end portion of the lower slit away from the top flap; and a second bottom slit extending downward from the second end portion of the lower slit away from the top flap, wherein the lower slit, the first bottom slit, and the second bottom slit define three sides of a lower flap.

2. The packaging container of claim 1, wherein the perforations are, as a group, positioned in a laterally central position in the sidewall.

3. The packaging container of claim 1, wherein the lower slit comprises a single slit extending from the first end portion to the second end portion.

4. The packaging container of claim 1, wherein the lower slit has a length of at least about 1.5 inches.

5. The packaging container of claim 1, wherein the apex defines an acute angle between the first side perforation and the second side perforation.

6. The packaging container of claim 1, wherein each of the first side perforation and the second side perforation is linear.

7. The packaging container of claim 1, wherein the lower slit, first side perforation, and second side perforation define a removable flap therebetween.

8. The packaging container of claim 7, wherein the removable flap has a triangular shape.

9. The packaging container of claim 7, wherein the removable flap is located on the sidewall below the opening.

10. The packaging container of claim 9, wherein a distance between the opening and the removable flap is at least about 1.0 inch.

11. The packaging container of claim 1, wherein the at least one top flap comprises two top flaps configured to fold toward a center of the opening.

12. The packaging container of claim 1, wherein the body comprises a cardboard body.

13. A method of forming a packaging container, comprising:

forming a body to include a sidewall and at least one top flap for at least partially covering an opening of the body when assembled; and forming a removable flap in the sidewall, comprising:

cutting the sidewall to form a lower slit parallel to the at least one top flap when assembled and having a first end portion and a second end portion;

cutting the sidewall downward from the first end portion of the lower slit away from the top flap to form a first bottom slit;

cutting the sidewall downward from the second end portion of the lower slit away from the top flap to form a second bottom slit, wherein the lower slit, the first bottom slit, and the second bottom slit define three sides of a lower flap;

perforating the sidewall upward toward the top flap from the first end portion of the lower slit to form a first side perforation; and perforating the sidewall upward toward the top flap from the second end portion of the lower slit to form a second side perforation, wherein the first side perforation and the second side perforation converge toward each other as they extend upward from the lower slit, wherein the first side perforation and the second side perforation converge to reach each other at a pointed apex.

14. The method of claim 13, wherein perforating comprises at least one of: forming a single slit, or forming a series of slits or holes.

15. The method of claim 13, wherein:

cutting the sidewall to form the lower slit comprises forming a single slit between the first end portion and the second end portion;

perforating the sidewall to form the first side perforation comprises forming a first series of multiple slits or holes; and perforating the sidewall to form the second side perforation comprises forming a second series of multiple slits or holes.

16. A method of securing a packaging container, the method comprising:

closing at least one top flap over an opening of the packaging container, the packaging container comprising a body including a sidewall and the at least one top flap;

adhering tape over the top flap to secure the top flap in a closed position; and positioning an end of the tape over a removable flap formed in a sidewall of the packaging container, wherein the removable flap is defined by:

a lower slit parallel to the at least one top flap and having a first end portion and a second end portion;

a first side perforation extending upward toward the top flap from the first end portion of the lower slit; and a second side perforation extending upward toward the top flap from the second end portion of the lower slit, wherein the first side perforation and the second side perforation converge toward each other as they extend upward from the lower slit, wherein the first side perforation and the second side perforation converge to reach each other at a pointed apex;

wherein the removable flap is positioned above a lower flap, defined by:

the lower slit;

a first bottom slit extending downward from the first end portion of the lower slit away from the top flap; and a second bottom slit extending downward from the second end portion of the lower slit away from the top flap.

17. The method of claim 16, wherein positioning the end of the tape over the removable flap comprises positioning the end of the tape over a triangular removable flap.

* * * * *